United States Patent [19]

Good

[11] Patent Number: 4,902,547

[45] Date of Patent: Feb. 20, 1990

[54] REINFORCING HANG TABS

[75] Inventor: David M. Good, Peachtree City, Ga.

[73] Assignee: Voxcom, Inc., Peachtree City, Ga.

[21] Appl. No.: 193,667

[22] Filed: May 13, 1988

[51] Int. Cl.[4] ..... B32B 7/06

[52] U.S. Cl. ..... 428/40; 156/289; 156/292; 248/205.3; 248/317

[58] Field of Search ..... 40/331, 360, 603, 604; 248/205.3, 317; 156/289, 292; 206/461, 806; 428/40, 131

[56] References Cited

U.S. PATENT DOCUMENTS

| | | | |
|---|---|---|---|
| 3,458,946 | 8/1969 | Lasswell | 248/205.3 X |
| 3,958,051 | 5/1976 | Smith | 156/289 X |
| 4,068,028 | 1/1978 | Samonides | 156/289 X |
| 4,101,701 | 7/1978 | Gordon | 156/292 X |
| 4,608,288 | 8/1986 | Spindler | 428/40 X |

*Primary Examiner*—Henry F. Epstein

*Attorney, Agent, or Firm*—Stonebraker, Shepard & Stephens

[57] ABSTRACT

Hand tabs (25) are reinforced by adhering a reinforcing band (14) to a head region (22) of a tab strip (11) while the adhesive coated surface of the tab strip is separated from a release liner (13). Tab strip (11), with its reinforcing band (14), is then rejoined with its liner (13); and hang tabs (25) with reinforced head regions (22) are die cut so that the tabs are secured in rows on the liner. This places reinforcing band (14) on the front faces of tabs (25), where their adhesive coating adheres them to objects or packages.

17 Claims, 4 Drawing Sheets

REINFORCING HANG TABS

BACKGROUND

Hang tabs for supporting packages on hanging wires of retail display racks can be made of thick and tough resin material that does not require any reinforcing. Such a resin strip is expensive, however, and needs a formed hinge line to be flexible enough to fold flat against a package, for shipping.

Hang tabs can also be made of a thinner and less expensive resin strip, but this requires a reinforcing layer in the hanging region of the tab. Such reinforcing has been done by adhering a reinforcing band to the reinforced region of the tab strip, before the tabs are die cut. This requires, besides the reinforcing band, an adhesive layer on the reinforcing band and a wasted liner strip covering that adhesive layer.

I have discovered a less expensive way of reinforcing the head or hanging region of a hang tab, and my reinforced tab does not require an additional liner or adhesive coating. Tabs reinforced according to my invention can be made less expensively, while performing reliably, and their reduced cost makes them competitively favored over previous ways of reinforcing hang tabs.

SUMMARY OF THE INVENTION

My way of reinforcing hang tabs involves separating a hang tab strip from its liner; adhering a reinforcing band to the adhesive surface of the tab strip, while it is separated from its liner; and rejoining the liner with the tab strip and the reinforcing band, before die cutting the hang tabs. This produces a reinforced hang tab having a single adhesive coating on the front face of the support strip, accomplishing two functions—adhering the tab to an object, and adhering a reinforcing band to the head region of the tab. Only a single liner and a single adhesive coating are required, and this reduces the cost of reinforcing hang tab strips according to my invention.

DETAILED DESCRIPTION

Figure 2:
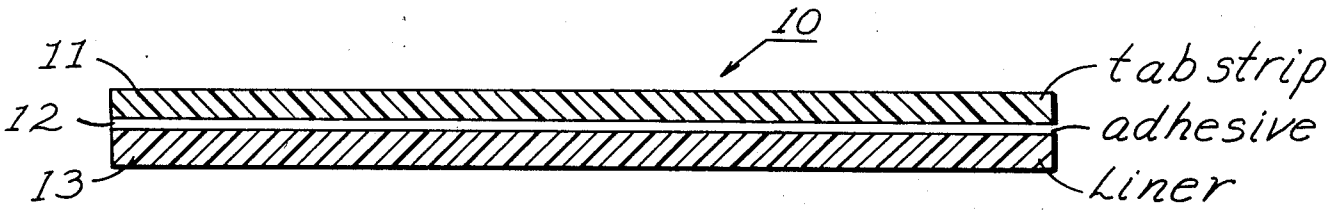
FIGS. 2–5 are cross-sectional views taken respectively along lines 2—2, 3—3, 4—4, and 5—5 of FIG. 1.

The reinforcing of hang tabs according to my invention begins with a supply web 10 that includes a tab strip 11 with an adhesive layer 12 covered by a release liner 13, as shown in FIG. 2. This is wound up in a supply roll 15 from which supply web 10 is fed to a hang tab cutting die 20. Between supply roll 15 and cutting die 20, tab strip 11 and its adhesive layer 12 are separated from liner 13: and while these are separated, reinforcing band 14 is adhered to the front face of tab strip 11.

Figure 1:
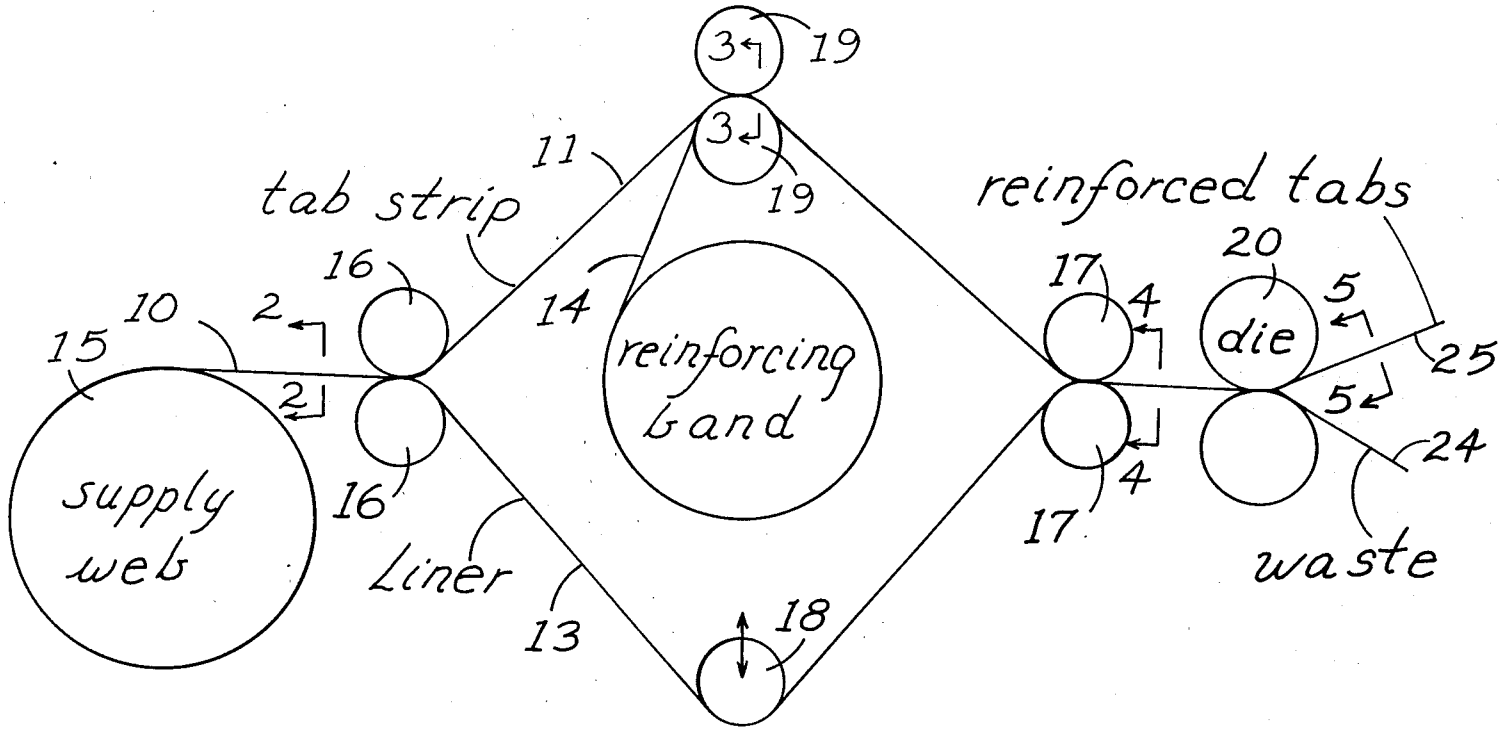
FIG. 1 is a schematic view of my way of reinforcing hang tabs.
Figure 3:
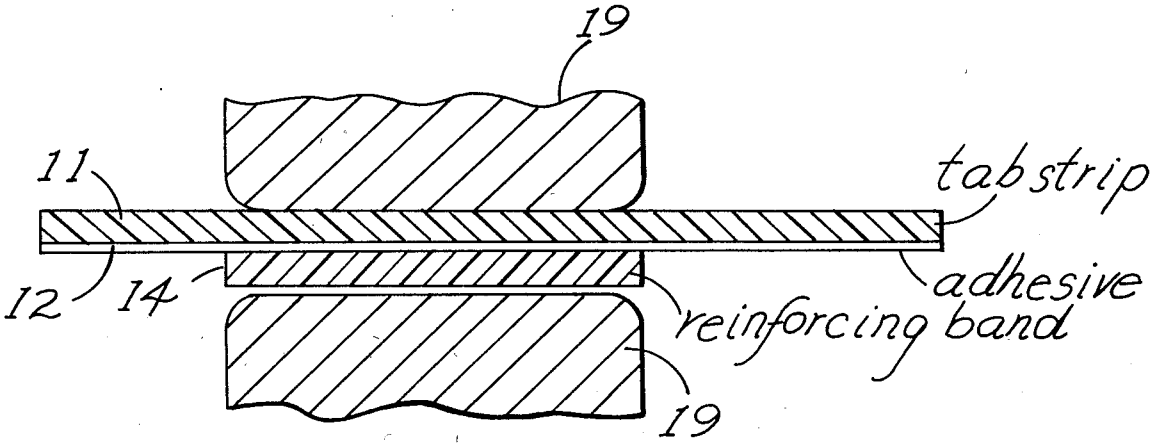
Figure 4:
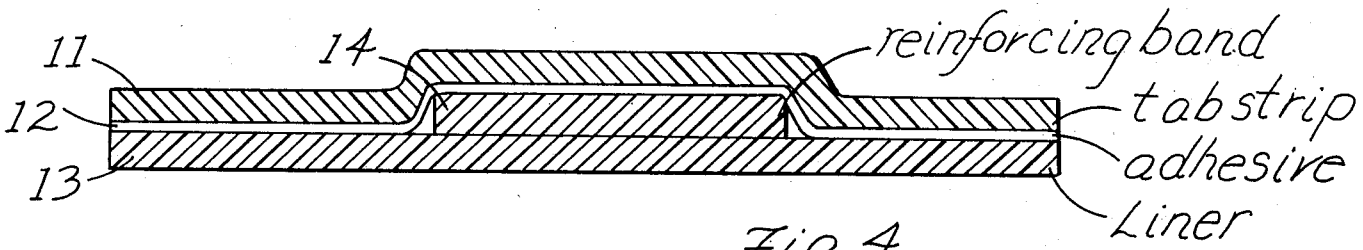

The separation of tab strip 11 and liner 13 occurs at rollers 16; and tab strip 11, with its reinforcing band 14, is recombined with liner 13 at rollers 17. A roller 18 engaging liner 13 is adjustable, as indicated by the arrow in FIG. 1, to ensure that liner 13 and tab strip 11 travel exactly equal distances during their separation between rollers 16 and 17. The adhering of reinforcing band 14 to the adhesive surface 12 of tab strip 11 is done with a pair of rollers 19, which register with reinforcing band 14 and press it against adhesive layer 12 of tab strip 11, without touching adhesive layer 12, as shown in FIG. 3. At recombining rollers 17, tab strip 11 is readhered to liner 13 by means of the portions of adhesive layer 12 that are not adhered to reinforcing band 14, as shown in FIG. 4.

Figure 5:
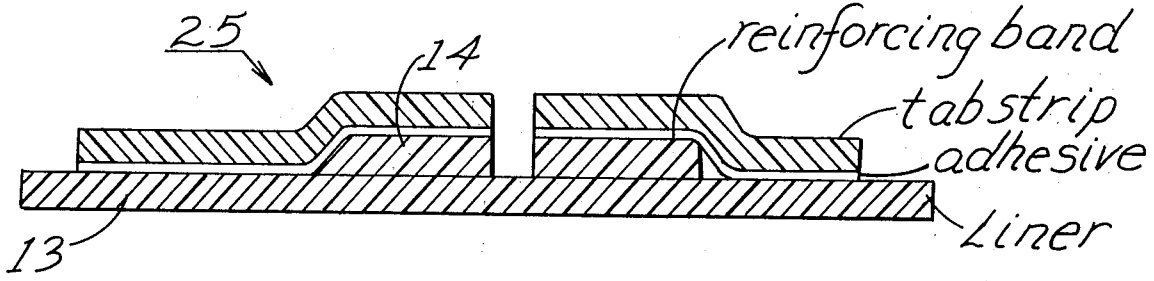

Reinforced hang tabs 25 are cut at die 20; and waste material 24 around each hang tab 25 is removed from liner 13, as generally known in the hang tab art. As shown in FIG. 5, this leaves hang tabs 25 supported on liner 13, which is used for advancing hang tabs 25 into machinery that adheres them to objects.

Figure 6:
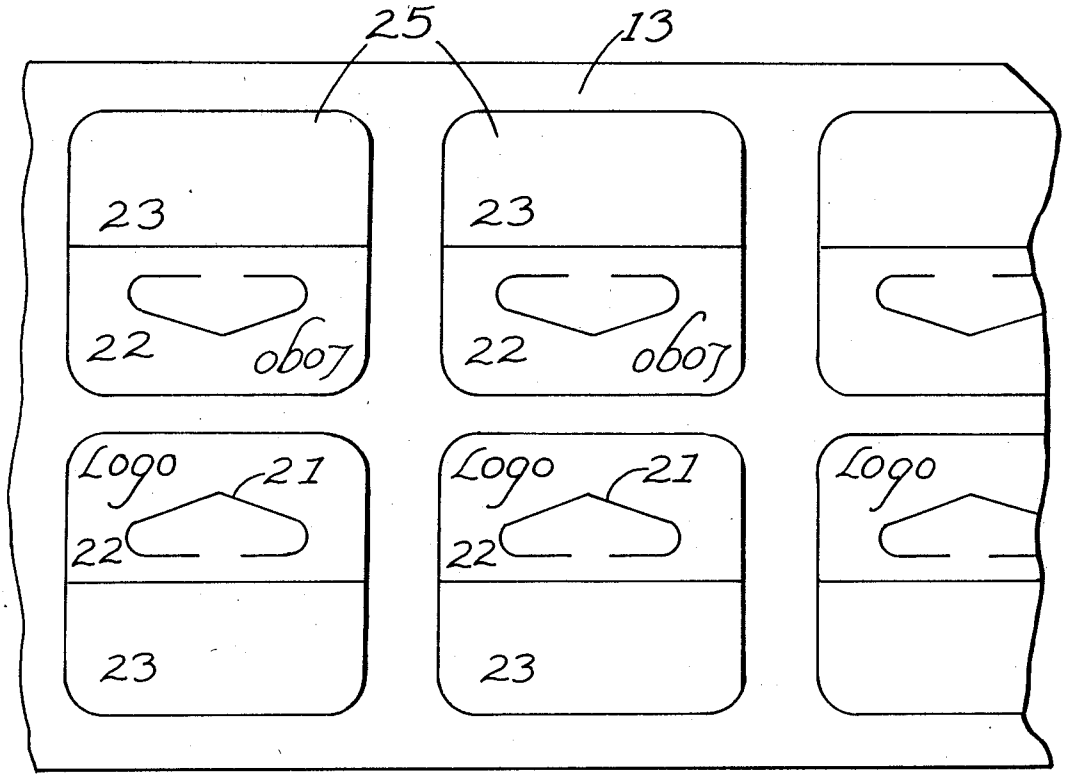
FIG. 6 is a plan view of reinforced hang tabs made according to my invention.

Two rows of hang tabs 25 are preferably arranged head to head on liner strip 13, as shown in FIG. 6. Reinforcing band 14 straddles the head regions 22 of both rows of tabs 25 and is arranged in a central region of liner 13, between liner 13 and tab strip 11, from which tabs 25 are cut. Stick-on regions 23 of tabs 25 are releasably adhered to liner 13 and are later adhered to objects or packages to be displayed. Reinforced head regions 22 have die cuts 21 that can open to receive a hanging wire.

Reinforcing band 14 can be printed paper or resin material. Paper is especially advantageous since it can easily be printed with logo, brand name, or other information, adding to the package display. Tab strip 11 is preferably formed of clear resin material so that it can be adhered to a package or object without concealing anything. Since reinforcing band 14 is adhered to the front face of tabs 25 in head regions 22, these are not adhered to liner 13.

In effect, the adhesive layer 12, on the front face of each tab 25, accomplishes two functions. It adheres reinforcing band 14 to hanging region 22, giving the tab head the necessary strength; and it also adheres each tab 25 to an object or package for display. Only a single release liner 13 is required over the single adhesive coating 12, allowing tabs 25 to be made more economically than previous reinforced hang tabs.

I claim:

1. A method of reinforcing hang tabs, said method comprising:

a. adhering a flexible hang tab strip to a release liner to form a supply web for making hang tabs;

b. advancing said supply web from a supply roll to a die that cuts said hang tabs;

c. separating an adhesive surface of said tab strip from said liner between said supply roll and said die;

d. while said tab strip and said liner are separated, securing a reinforcing band to said adhesive surface along a reinforced region of said tab strip; and e. rejoining said liner with said tap strip and said reinforcing band before said supply web reaches said die.

2. The method of claim 1 including extending said adhesive surface for a full width of said tab strip.

3. The method of claim 1 including making said reinforcing band of printed paper.

4. The method of claim 1 including adjusting the paths of said tab strip and said liner to be equal in length while said tab strip and said liner are separated.

5. The method of claim 1 including using a roller registered with said reinforcing band and not engaging said adhesive surface for securing said reinforcing band to said tab strip.

6. The method of claim 1 including die cutting two rows of said hang tabs arranged head to head on said tab strip, and arranging said reinforcing band to span head regions of said rows.

7. The method of claim 1 including making said reinforcing band of clear resin material.

8. A supply strip of reinforced hang tabs individually adherable to an object to be hung on a wire hanger for display, said supply strip comprising:

a. a release liner extending along said supply strip and releasably supporting a row of said hang tabs;

b. said hang tabs being die cut from a flexible and transparent resin material;

c. an adhesive coating on a front face of each of said hang tabs, said adhesive coating adhering a stik-on region of each of said hang tabs to said release liner, and said stick-on region, after release from said liner, being adherable by said adhesive coating to said object;

d. a reinforcing band adhered by said adhesive coating to said front face of a hanging region of each of said hang tabs, said reinforcing band being interposed between said hang tabs and said liner, and said reinforcing band not being adhered to said liner; and e. said hang tab and said reinforcing band being die cut in said hanging region to allow said hanging region to be hung on a hanger.

9. The supply strip of claim 8 wherein said reinforcing band is printed paper.

10. The supply strip of claim 8 wherein said reinforcing band is clear resin.

11. The supply strip of claim 8 wherein said adhesive coating covers all of said front face of each of said hang tabs.

12. A method of making hang tabs of a resin strip and a reinforcing band, said method comprising:

a. forming an adhesive coating on a front surface of said resin strip, said adhesive coating being covered with a releasable liner;

b. separating said releasable liner from said resin strip, and while said resin strip and said releasable liner are separated, adhering said reinforcing band to said front surface of said strip along a reinforced region of said strip;

c. recombining said liner with said strip and said band so that said liner sticks to an adhesive region of said strip not covered by said reinforcing band; and d. die cutting said strip and said reinforcing band into said row of hang tabs releasably adhered to said liner.

13. The method of claim 12 including making said liner and said strip travel equal length paths, while separated.

14. The method of claim 12 including using a roller registered with said reinforcing band and not engaging said adhesive, for adhering said band to said strip.

15. The method of claim 12 including making said reinforcing band wide enough to span head regions of opposed hang tabs die cut in two rows arranged head to head.

16. The method of claim 12 including using printed paper for said reinforcing band.

17. The method of claim 12 including using clear resin for said reinforcing band.

* * * * *